United States Patent [19]

Biby

[11] Patent Number: 4,479,274

[45] Date of Patent: Oct. 30, 1984

[54] SWIMMING POOL SIPHON

[76] Inventor: Robert Biby, 421 Arrowhead, Troy, Ill. 62294

[21] Appl. No.: 393,667

[22] Filed: Jun. 30, 1982

[51] Int. Cl.[3] ..... E04H 3/18

[52] U.S. Cl. ..... 4/496; 4/507; 137/123; 137/135; 137/142; 137/151

[58] Field of Search ..... 137/142, 151, 135, 409, 137/123; 4/496, 507

[56] References Cited

U.S. PATENT DOCUMENTS

| | | | |
|---|---|---|---|
| 16,154 | 12/1856 | Walker | 137/151 |
| 264,197 | 9/1882 | Saunders | 137/142 |
| 340,574 | 4/1886 | Handy | 137/151 |
| 378,811 | 2/1888 | Tyler | 137/142 X |
| 649,313 | 5/1900 | Jewell | 137/123 |
| 665,826 | 1/1901 | Carroll | 137/142 X |
| 1,059,116 | 4/1913 | Chapin | 137/135 X |
| 1,661,202 | 3/1928 | Thayer | 137/142 X |
| 1,661,699 | 3/1928 | Magnin | 137/142 X |
| 2,272,655 | 2/1942 | Briese | 137/142 X |
| 2,330,074 | 9/1943 | Morris et al. | 137/151 |
| 2,393,867 | 1/1946 | Nicholson | 137/151 |
| 2,712,918 | 7/1955 | Simpson | 137/151 X |
| 3,011,510 | 12/1961 | Stadifird | 137/151 |
| 4,318,421 | 3/1982 | Ward | 137/135 |

*Primary Examiner*—Henry K. Artis

[57] ABSTRACT

A swimming pool siphon for draining above the ground swimming pools. The siphon is comprised of a generally U-shaped tubular construction having two legs connected by a top bight portion restable upon a top edge of the side wall of the swimming pool. The leg ends are supportable upon the ground and the pool floor and have removable closure caps while a fill cap is provided upon the bight portion. A pool leg may also be provided with a flattened end to drain water closely to the pool floor. After filling the fill cap is closed and siphoning commences upon the removal of the closure caps. The drain leg may be bent or rotated for use with in ground swimming pools and leg extensions may be added as needed.

5 Claims, 4 Drawing Figures

SWIMMING POOL SIPHON

BACKGROUND OF THE INVENTION

In the past swimming pools of one type or another have all been required to be drained periodically for maintainance or cleaning. In northern climates draining is usually required during the winter months to prevent freeze damage.

Such draining has generally required the use of pumps which entails a considerable expense and access to a source of power which may not be readily accessible. For swimming pools that are raised above the ground and are supported upon the ground level such added expense may make the cost unacceptable and the absence of a source of power for a pump may greatly add to the inconvenience of draining to the pool.

SUMMARY OF THE INVENTION

By means of the instant invention there has been provided a swimming pool siphon which is particularly designed for use with above the ground swimming pools but which with appropriate extensions may be used for conventional below the ground pools.

The pool siphon is comprised of a generally U-shaped tubular bifurcated siphon having two legs which are connected by an intermediate bight portion. Each of the legs is provided with a removable cap at an outlet end and a fill cap at the intermediate bight portion.

The pool siphon is employed by placing the siphon over the conventional raised side wall of the above the ground pool in a straddling manner such that the bight portion is supported upon a top edge of the side wall and one leg extends beneath the water level in the pool and the outer leg extends outside the pool for drainage.

The pool siphon is filled with water and then capped at the bight portion fill cap. Siphoning is commenced by removing the pool leg cap and then removing the drainage leg. Each of the legs has an end outlet portion which may be L-shaped for convenience in draining the pool in the pool leg and directing the flow in the drainage leg. Appropriate tubular extensions may be added to the drainage leg for directing the drainage to any selected area.

In order to drain closely to the bottom of the pool the outlet end of the pool leg may be provided with a flattened end fitting. By placement on the pool bottom the narrow horizontally extending slot-like opening permits close to the bottom drainage.

The pool siphon may also be employed in below the ground swimming pools by extending the outlet end of the drain leg to a point below the pool floor. This may be facilitated by the employment of a flexible tubular drain leg with appropriate extensions as needed or by providing a rotatable or swivel connection for the juncture of the drain leg with the intermediate bight portion to angle the drain leg toward a horizontal position at the pool edge whereby leg extensions can be added to lead to a ground level below the pool floor.

The swimming pool siphon of this invention is rugged and simple in construction and can be effectively used without the requirement of a source of any type of power or any moving parts which might be a source of malfunction. The siphoning operation may be performed by the average person as well as children without the need of any special training at nominal cost.

The above features are objects of this invention. Further objects will appear in the detailed description which follows and will be further apparent to those skilled in the art.

For the purpose of illustration of this invention preferred embodiments thereof are shown in the accompanying drawing. It is to be understood that the drawing is for purpose of description only and that the invention is not limited thereto.

IN THE DRAWING

DESCRIPTION OF THE INVENTION

Figure 1:
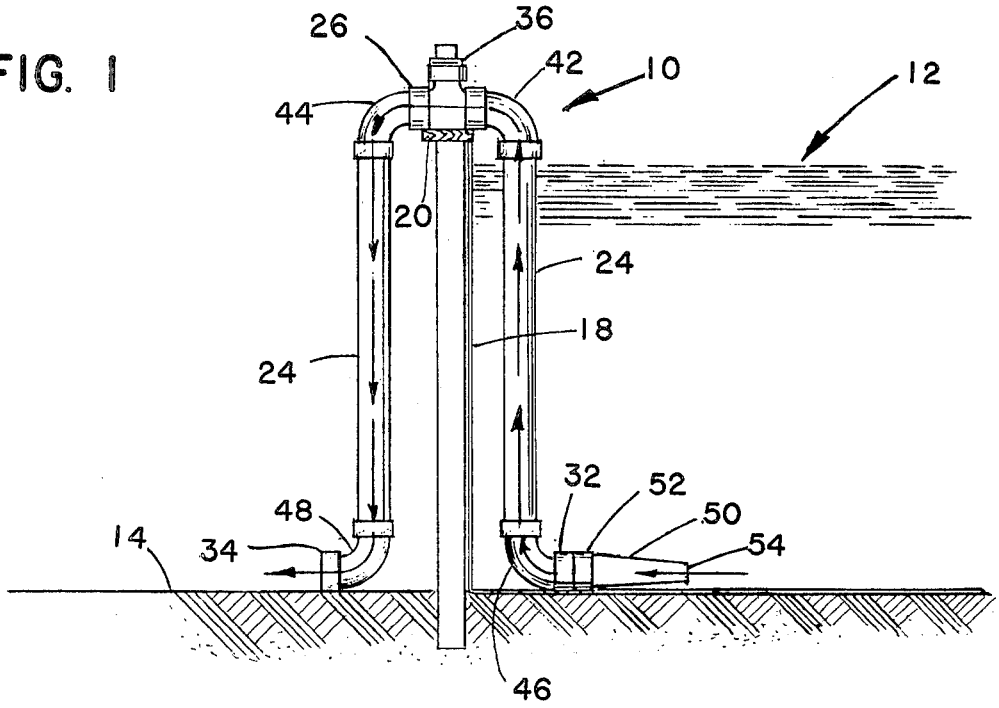
FIG. 1 is a view in vertical section through a wall of an above the ground swimming pool showing the use of the pool siphon with a flattened attachment.
Figure 2:
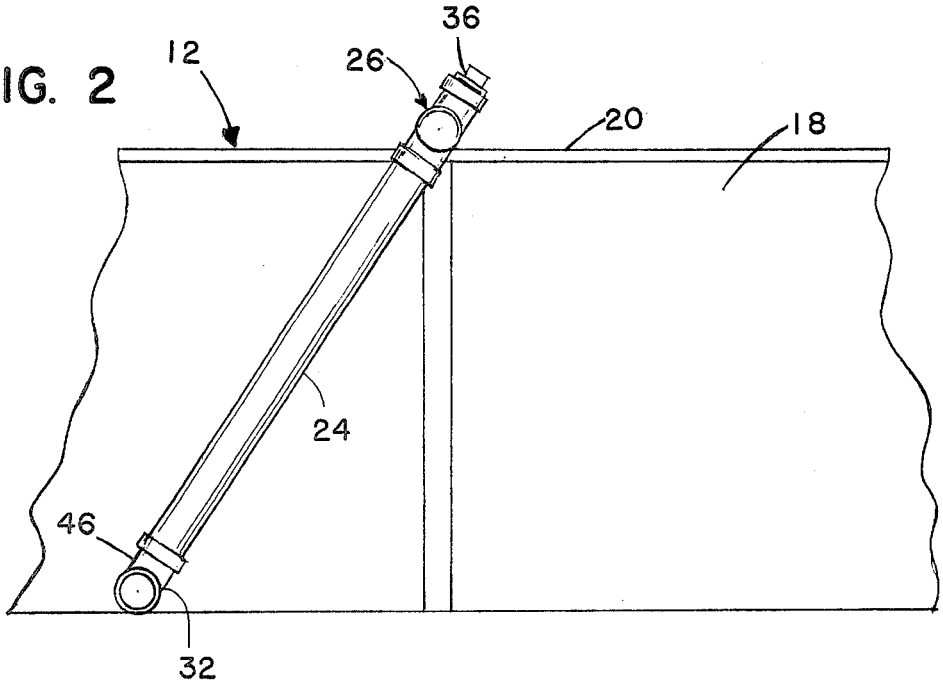
FIG. 2 is a view in side elevation taken from the left side of FIG. 1 showing the support of the pool siphon without the flattened attachment.

The swimming pool siphon of this invention is generally identified by the reference numeral 10 in FIGS. 1 through 4 where it is shown supported in an above the ground swimming pool 12 supported upon the ground level 14. The swimming pool has a floor 16 and a vertical side wall 18 having a top edge 20 which provides a support for the pool siphon.

The pool siphon is of a generally U-shaped bifurcated configuration comprising a tubular pool siphon leg 22, a tubular drain leg 24 and an intermediate bight portion 26. The legs may be conveniently constructed of rigid or semi-rigid plastic material or may be flexible in whole or in part.

Closure caps 28 and 30 are provided for outlet ends 32 and 34 respectively for the pool leg 22 and drain leg 24, respectively. The connections may be made by a simple male-female threaded fit or a friction fit to provide a proper seal as desired. In order to fill the siphon a fill cap 36 is provided for a fill opening 38 in the intermediate bight portion which represents the highest portion of the pool siphon.

The intermediate bight portion is comprised of a tubular tee threaded fitting 40 to which are connected elbows 42 and 44 that are threadedly connected to the afore-mentioned pool and drain legs. As will appear more fully hereinbelow for use in draining a below the ground swimming pool the drain leg side of the siphon may be turned or angled toward the horizontal by turning the elbow 44 and drain leg through the threaded or friction fit connection with the tee junction. The angling or turning may also be effected by a flexible construction of the drain leg.

The pool and drain legs are provided at their lower ends with elbows 46 and 48 respectively. These elbows provide the outlets to the legs and are directed horizontally to facilitate the leg support upon the pool floor and ground and direct flow in a desirable fashion. The ends of the elbows may be threaded as previously mentioned to receive the closure caps or a friction fit may be employed as desired.

Figure 4:
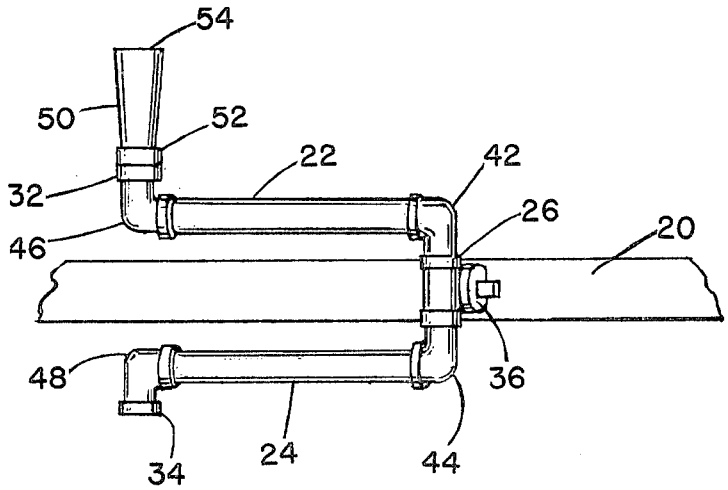
FIG. 4 is a top plan view showing the support of the pool siphon.

In order to drain closely to the bottom of the pool a flattened adaptor 50 may be employed as shown in FIGS. 1 and 4. The adaptor has an end 52 receivable on the elbow outlet 32 and has a flattened horizontally extending narrow slot-like opening 54 at the opposite end which may be laid flat on the pool floor.

USE

Figure 3:
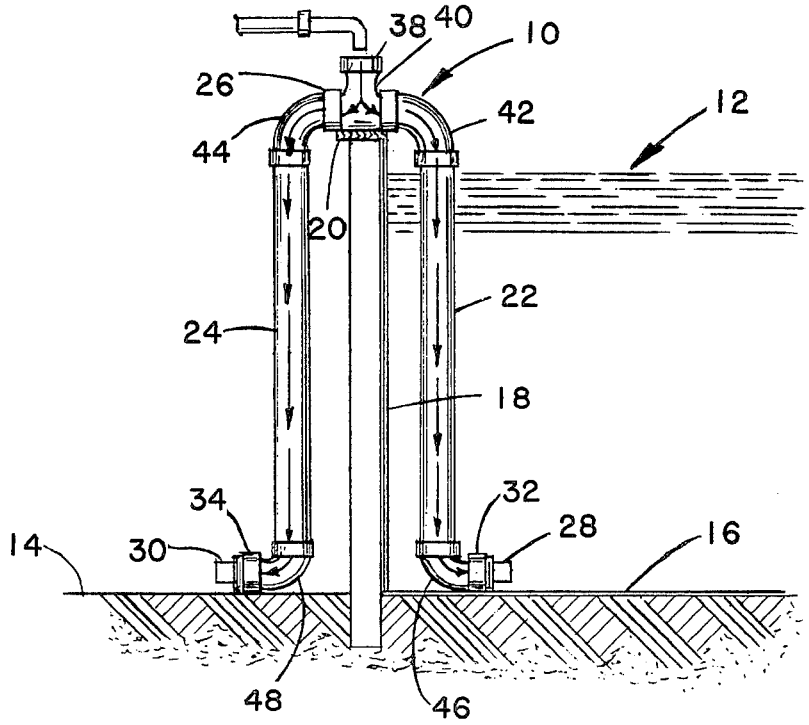
FIG. 3 is a view similar to FIG. 1 showing the filling of the siphon prior to use.

The pool siphon in use is placed on the top edge 20 of the side wall 18 of the above the ground swimming pool as best shown in FIG. 3. The end caps 28 and 30 for the pool leg and drain leg are connected and the fill cap 36 is removed. In this position the pool and drain legs closely straddle the side wall of the pool with the intermediate bight portion resting on the top edge of the side wall. A three point support is provided with the capped ends of the pool and drain legs resting on the pool floor and outside ground level, respectively.

The pool siphon is then filled with water to the brim of the fill inlet 38. After filling the fill cap 36 is replaced and the siphoning operation is ready.

The siphoning is commenced by removing the pool leg cap 28 which may be effected by lifting the leg while ensuring that the capped end remains fully immersed below the water level of the pool. The drain leg cap 30 is then removed. As soon as the latter cap is removed the siphoning action commences and the pool water begins draining at considerable force through the outlet of the drain leg.

For draining closely to the floor of the pool the adaptor or attachment 50 may be utilized. This may be attached during the siphoning operation by connection of the end 52 to the end 32 of the pool leg, as shown in FIGS. 1 and 4. The attachment is laid flat on the pool floor and the horizontally extending narrow slot-like opening resting on the pool floor enables the draining of the pool to a very low level. The attachment may also be used in the filling operation by providing a removable plug or cover for the opening which is removed in the siphoning operation.

The pool siphon when used with pool and drain legs of a diameter of three inches can, as an example, establish a drainage flow of approximately one-hundred gallons per minute. Thus a four feet deep pool of twenty-four feet in diameter containing approximately twelve thousand gallons of water may be drained in about two hours.

While the pool siphon has been described primarily for use with above the ground swimming pools having the side wall and top edge or rim employed as a support it may also be employed for below the ground or in ground swimming pools. For such use the drain leg can be extended by appropriate tubular extensions using as many as are needed to reach a drain level below the pool floor.

In order that the drain leg 26 not interfere with the deck or border area of the pool it may be rotated or angled toward a horizontal position rather than the vertical position shown in the drawing. This may also be accomplished by employing a flexible drain leg or by rotating the leg and the elbow 44 with respect to the tee junction 40 of the intermediate bight portion to the desired position.

Various changes and modifications may be made within this invention as will be apparent to those skilled in the art. Such changes and modifications are within the scope and teaching of this invention as defined in the claims appended hereto.

What is claimed is:

1. A swimming pool siphon for above the ground swimming pools having a side wall extending above the pool floor and a pool ground support, said pool siphon comprising a bifurcated siphon having two tubular legs acting as a pool leg and a drain leg connected at a bight portion, said bight portion being comprised of a tee junction connected at opposite sides to tubular elbows, each of said elbows being connected to one of said legs, said bight portion having a width exceeding the width of said side wall of the pool and receivable on a top edge of said wall in a rest support position to provide a close straddling-relation of said elbows over said wall, said pool leg having a length at least equal to the height of the side wall so as to be supportable upon the floor of the pool, said drain leg having an outlet extending parallel to the ground whereby the outlet flow may be horizontal and parallel to the ground support, closure means for end portions of each of said legs and removable cap means for said bight portion to provide for filling said pool siphon with water, said closure means being operable to open the legs upon filling of the pool siphon to establish a siphon flow to drain water from said pool, said legs with the bight portion forming a substantially U-shaped construction and being substantially parallel to one another and having a length exceeding the distance between a top edge of the side wall and the pool floor and ground level to provide a three point contact of the pool siphon established by the resting of the bight portion upon the top edge of the side wall, the resting of the outlet end of the pool leg upon the pool floor and the outlet end of the drain leg upon the ground.

2. The swimming pool of claim 1 in which said pool leg is provided with a relatively narrow flattened horizontally extending outlet adapted to be supported upon said floor for draining the water close to the floor.

3. The swimming pool of claim 1 in which said siphon has a substantial rigidity to facilitate said three point contact and support.

4. The swimming pool of claim 1 in which said drain leg is rotatable from a vertical to a substantially horizontal position.

5. The swimming pool of claim 4 in which the said drain leg is connected to a tubular elbow member comprising a relatively rotatable part of said bight portion and said leg and elbow are relatively rotatable from a vertical to a substantial horizontal position.

* * * * *